US008660451B2

(12) United States Patent
Yamaki et al.

(10) Patent No.: US 8,660,451 B2
(45) Date of Patent: Feb. 25, 2014

(54) CLEANING APPARATUS AND IMAGE FORMING APPARATUS

(75) Inventors: Hideo Yamaki, Hachioji (JP); Shigetaka Kurosu, Hino (JP); Nobuyasu Tamura, Toyokawa (JP); Hajime Kawakami, Hino (JP); Yusuke Nishisaka, Hachioji (JP); Keiki Katsumata, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 176 days.

(21) Appl. No.: 13/186,643

(22) Filed: Jul. 20, 2011

(65) Prior Publication Data

US 2012/0020693 A1 Jan. 26, 2012

(30) Foreign Application Priority Data

Jul. 23, 2010 (JP) ..... 2010-165604

(51) Int. Cl.
*G03G 15/00* (2006.01)

(52) U.S. Cl.
USPC ..... 399/71; 399/101

(58) Field of Classification Search
USPC ..... 399/71, 99, 101, 343, 350
See application file for complete search history.

(56) References Cited

U.S. PATENT DOCUMENTS

| | | | | |
|---|---|---|---|---|
| 5,669,054 | A * | 9/1997 | Uchida et al. | 399/313 |
| 6,963,703 | B2 * | 11/2005 | Hisakuni | 399/71 |
| 7,024,127 | B2 * | 4/2006 | Hisakuni | 399/71 |
| 7,092,660 | B2 * | 8/2006 | Tanaka et al. | 399/227 |
| 7,313,343 | B2 * | 12/2007 | Tanaka et al. | 399/101 |
| 7,826,764 | B2 * | 11/2010 | Takahashi | 399/101 |
| 7,907,867 | B2 * | 3/2011 | Moro et al. | 399/101 |
| 8,086,128 | B2 * | 12/2011 | Takahashi | 399/71 |
| 8,369,766 | B2 * | 2/2013 | Edure et al. | 399/350 |
| 2008/0193179 | A1 * | 8/2008 | Sugimoto et al. | 399/354 |

FOREIGN PATENT DOCUMENTS

| | | | | |
|---|---|---|---|---|
| JP | 08137357 | A * | 5/1996 | G03G 21/10 |
| JP | 2002-40894 | A | 2/2002 | |
| JP | 2008-129404 | A | 6/2008 | |
| JP | 2011227180 | A * | 11/2011 | G03G 15/16 |

OTHER PUBLICATIONS

Elastic Properties and Young Modulus for some Materials. The Engineering ToolBox. Retrieved from web site May 2, 2013.*

Notice of Reasons for Refusal for Japanese Patent Application No. 2010-165604, drafted Sep. 27, 2013, with English translation.

* cited by examiner

*Primary Examiner* — David Gray
*Assistant Examiner* — Carla Therrien
(74) *Attorney, Agent, or Firm* — Cantor Colburn LLP

(57) ABSTRACT

A cleaning device for cleaning a belt member, includes a cleaning blade; a removing member coming in contact with the surface of the belt member so as to remove foreign matter adhering on the surface of the belt member; and a contact pressure changing section to change a contact pressure between the removing member to the belt member, wherein, when the contact pressure between the removing member and a region of the belt member corresponding in position to a toner image to be not transferred to a paper sheet is made P1, and the contact pressure between the removing member and a region of the belt member corresponding in position to a toner image to be transferred to a paper sheet is made P2, the contact pressure changing section changes the contact pressure to satisfy the conditional formula: (P1<P2).

6 Claims, 8 Drawing Sheets

CLEANING APPARATUS AND IMAGE FORMING APPARATUS

This application is based on Japanese Patent Application No. 2010-165604 filed on Jul. 23, 2010 in Japanese Patent Office, the entire content of which is hereby incorporated by reference.

BACKGROUND OF THE INVENTION

The present invention relates to a cleaning apparatus and an image forming apparatus.

In the image forming apparatus which forms an image on a paper sheet with toner, generally, a cleaning blade which is cheaper and has a high cleaning performance is employed as a cleaning member to clean a belt member which rotates by coming in contact with a part of a photoreceptor or an intermediate transfer belt which are a image carrying member to carry a toner image.

In such a cleaning apparatus, in order to prevent scattering of toner during a cleaning operation by a cleaning blade, it is well known to provide a seal member to prevent scattering of toner at an upstream side of the cleaning blade in the rotation direction of the belt member, (for example, refer to Patent document 1).

Moreover, in order to suppress the chipping and abrasion of the edge portion of a cleaning blade, and to improve durable performance, it is well known to supply toner to a blade edge portion periodically, and to provide a toner storage section.

Patent documents 1: Japanese Unexamined Patent Publication No. 2002-40894, Official report On a belt member of an image forming apparatus, foreign matter which has viscous properties and strong cohesive force may adhere in addition to toner. For example, in the case where a belt member (also referred to as a transfer belt) is used at a section where a toner image is transferred from an image carrying member to a paper sheet, when an image is printed on the reverse surface of a paper sheet at a time of double-side printing, an image formed on the obverse side of the paper sheet comes in contact with the belt member, and wax exuded on the obverse surface of the paper sheet may adhere on the belt member as foreign matter.

Toner adhering to a belt member can be removing cleanly by a cleaning blade. However, if foreign matter which has viscous properties and strong cohesive force adheres on the belt member, it is difficult for the cleaning blade to remove such foreign matter. In some case, such foreign matter comes in between the belt member and the cleaning blade, and disturbs the cleaning operation of the cleaning blade. Further, the foreign matter forms a film on the belt member and increases the friction force of the cleaning blade, which causes turning or twisting of the belt member.

However, with the seal member described in Patent document 1, it is difficult to remove foreign matter having strong cohesive force.

For this reason, for the cleaning apparatus of a belt member which rotates by coming in contact with an image carrying to carry a toner image, it is required to have a structure which can remove foreign matter so as not to be sandwiched by a cleaning blade and can supply toner properly to the cleaning blade so as to maintain a proper friction force.

SUMMARY OF THE INVENTION

In view of the above problems, an object of the present invention is to provide a cleaning apparatus and an image forming apparatus which can remove foreign matter so as not to be sandwiched by a cleaning blade, and can supply toner properly to the cleaning blade so as to suppress poor cleaning and turning of the cleaning blade.

The above object can be attained by the following structure which reflects one aspect of the present invention.

A cleaning device for cleaning a belt member which rotates by coming in contact with a part of an image carrying member on which a toner image to be transferred to a paper sheet and a toner image not to be transferred to a paper sheet are formed, comprises:

a cleaning blade to remove toner adhering on the surface of the belt member;

a removing member which is installed at an upstream side of the cleaning blade in a rotation direction of the belt member and comes in contact with the surface of the belt member in a counter direction to the rotation direction of the belt member so as to remove foreign matter adhering on the surface of the belt member; and a contact pressure changing section to change a contact pressure between the removing member and the belt member, wherein, when the contact pressure between the removing member and a region of the belt member corresponding in position to a toner image to be not transferred to a paper sheet is made P1, and the contact pressure between the removing member and a region of the belt member corresponding in position to a toner image to be transferred to a paper sheet is made P2, the contact pressure changing section changes the contact pressure to satisfy the conditional formula: (P1<P2).

DETAILED DESCRIPTION OF THE PREFERRED EMBODIMENT

Hereafter, although the present invention will be explained based on embodiments, the present invention is not limited to these embodiments.

[Outline of an Image Forming Apparatus]

Figure 1:
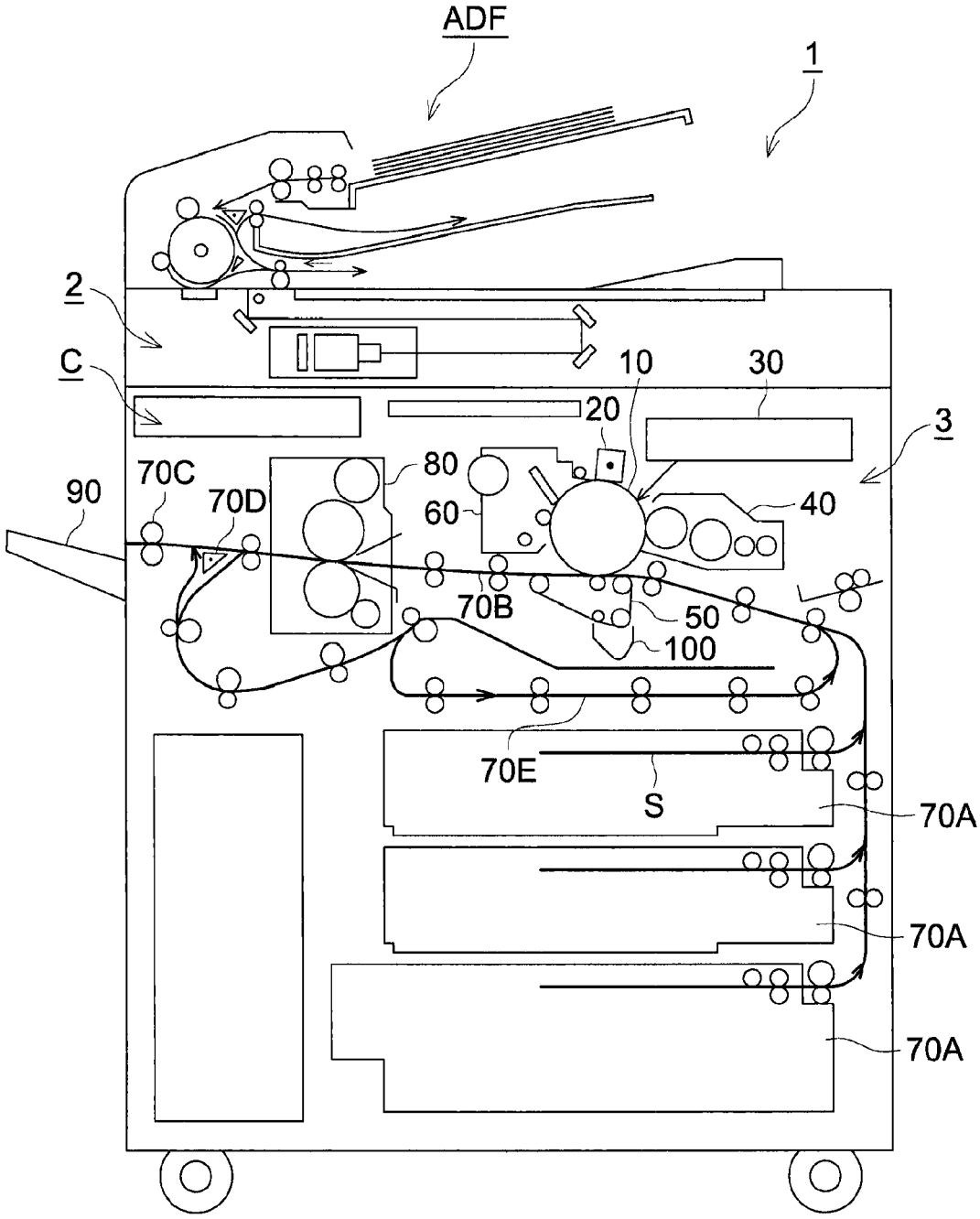
FIG. 1 is an entire structure view of an image forming apparatus relating to the present embodiment.

FIG. 1 is an entire configuration view of the image forming apparatus 1 according to this embodiment.

The image forming apparatus 1 shown in FIG. 1 includes an automatic document feeding unit ADF on the top surface; a reading section 2 which reads a document image fed by the automatic document feeding unit ADF and sends image data to a memory of a control section C, and an image forming section 3 which forms an image on a paper sheet based on the image data output from the control section C.

The image forming section 3 is structured such that an electrically charging section 20, an image exposing section 30, a developing section 40, a transfer belt (belt member) 50, and a cleaning section 60 are arranged around a rotatable image carrying member 10. After a surface of the image carrying member 10 is uniformly charged by the electrically charging section 20, the image exposing section 30 performs an exposure scanning with a laser beam on the surface of the image carrying member 10 so as to form a latent image. Then, the latent image is developed with a reversal development by the developing section 40 so that a toner image is formed on the surface of the image carrying member 10.

A paper sheet S is fed from a sheet storage section 70A, and is conveyed to a transfer position. Successively, at the transfer position, a toner image is transferred onto the paper sheet S by the transfer belt 50. After that, charge on the reverse surface of the paper sheet S is eliminated so that the paper sheet S is separated from the image carrying member 10, and is conveyed by a conveyance section 70B. The toner image is heated and fixed on the paper sheet S by the fixing section 80, and the paper sheet S on which the toner image has been fixed with heat is delivered on a sheet delivery tray 90 by a sheet delivering roller 70C.

In the case where image formation is conducted on both sides of the paper sheet S, the paper sheet S on which the toner image has been fixed with heat by the fixing section 80 is separated from an ordinary sheet delivery path by a conveyance path changing plate 70D. The paper sheet S is subjected to a switch back operation on a reverse conveyance section 70E so as to turn over from the obverse surface to the reverse surface, and a toner image is formed on the reverse surface. After the toner image is heated and fixed on the reverse surface of the paper sheet S, the paper sheet S is delivered on the sheet delivery tray 90 by the sheet delivering roller 70C.

A cleaning apparatus 100 which removes toner and the like adhering on the transfer belt 50 is installed beneath the transfer belt 50. The surface of the transfer belt 50 is always kept clean by the cleaning apparatus 100, so that a paper sheet S discharged from the image forming apparatus 1 is not likely to become dirty with toner and the like.

Figure 2:
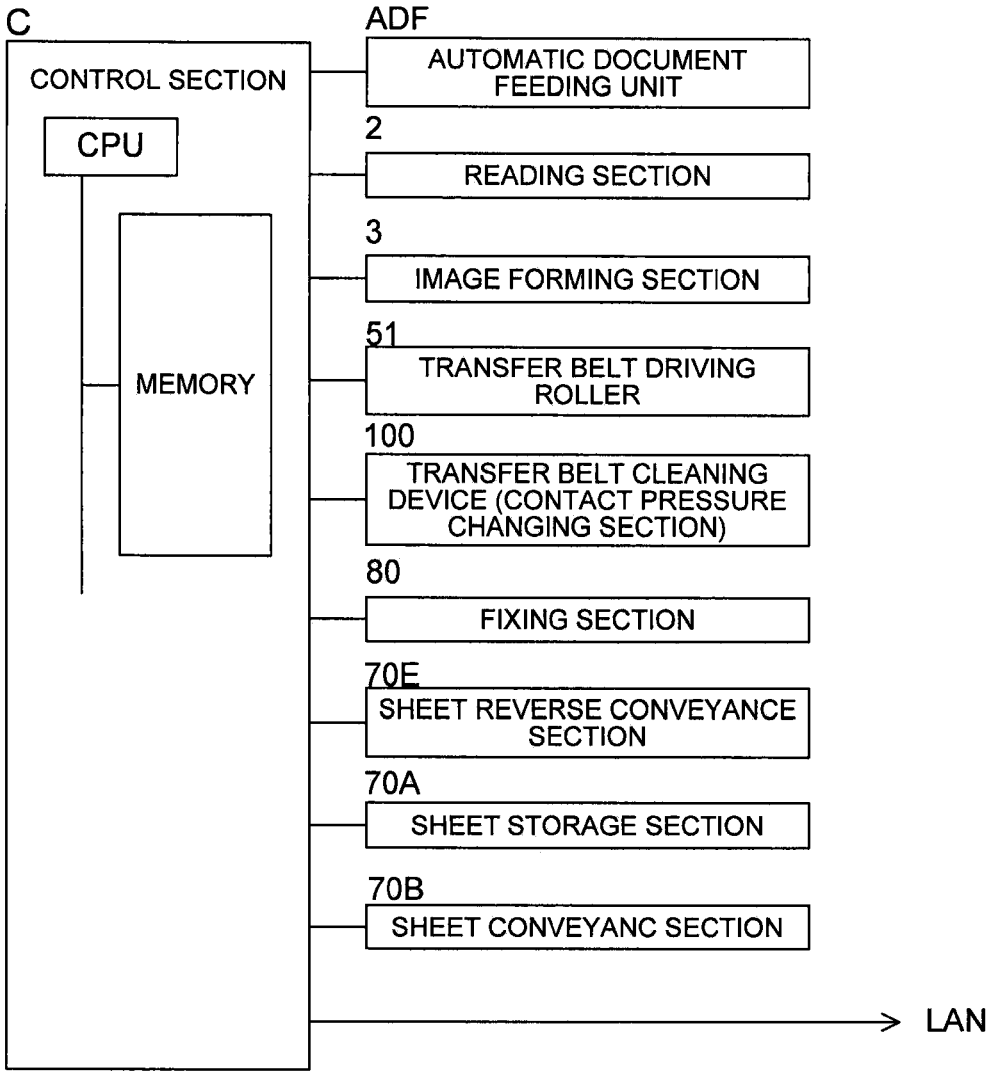
FIG. 2 is a block diagram showing a control relationship of the image forming apparatus relating to the present embodiment.

FIG. 2 is a block diagram showing a control relationship of the image forming apparatus 1 relating to this embodiment.

A control section C is a computer system which includes a CPU, a memory, an arithmetic unit, an input/output interface, a communication interface, and a driving circuit, and control for each unit is performed by execution of a predetermined program stored in the memory.

In this connection, in this block diagram, the description for blocks which are not directly related to the explanation of the present invention is omitted.

Figure 3:
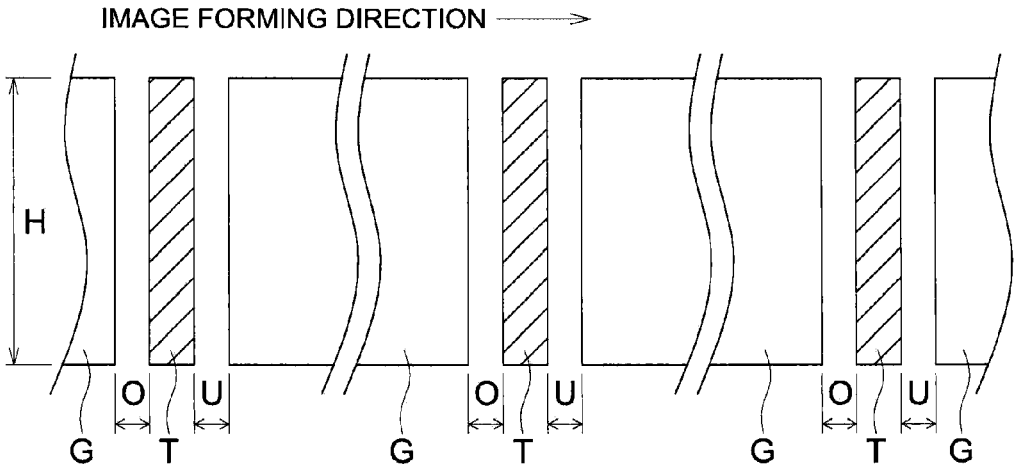
FIG. 3 is a toner image formed on an image carrying member in the image forming apparatus relating to the present embodiment.

FIG. 3 is a drawing showing toner images formed on the image carrying member 10 in the image forming apparatus 1 relating to this embodiment.

As shown in the drawing, toner images G to be transferred to a paper sheet and toner bands T being toner images formed at locations where the toner images are not transferred to a paper sheet are adapted to be formed on the image carrying member 10 of the image forming section 3 in the image forming apparatus 1 relating to this embodiment. These toner bands T are not transferred to a paper sheet, but are transferred to the transfer belt 50.

As shown in the drawing, for example, when toner images G to be transferred onto the predetermined number of paper sheets are formed, each of the toner bands T which are toner images not transferred to a paper sheet is formed between the toner images G. In this regard, a timing to form toner bands Ton the image carrying member is not to the above manner. For example, a toner band T may be formed every time between toner images G, or may be formed after a predetermined number of jobs are finished.

Next, the structures of the transfer belt 50 and the cleaning apparatus 100 of the transfer belt 50 will be explained in detail.

[Outline of a Transfer Belt and a Cleaning Apparatus]

Figure 4:
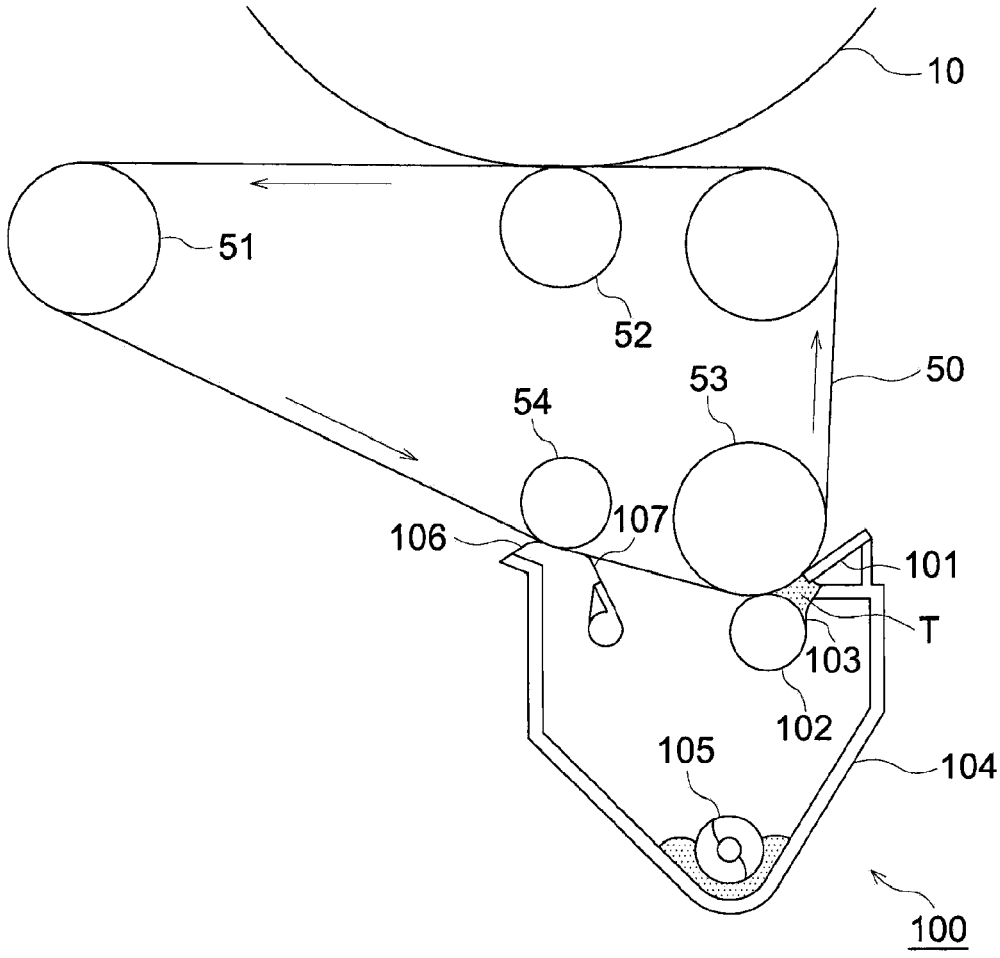
FIG. 4 is an enlarged cross sectional schematic view of a transfer belt and a cleaning apparatus of the transfer belt.

FIG. 4 is an enlarged cross section schematic diagram of the transfer belt 50 and the cleaning apparatus 100 of the transfer belt 50.

As shown in FIG. 4, the transfer belt 50 is stretched over around a plurality of rollers, and the transfer belt 50 is rotated in the arrowed direction in FIG. 4 by driving force of a driving roller 51. A transfer roller 52 is installed at a position opposite to the image carrying member 10, and at a location where the transfer roller 52 is opposite to the image carrying member 10, a toner image on the image carrying member 10 is transferred to a paper sheet S. The material of the transfer belt 50 is polyimide, and for example, a belt with a thickness of about 100 μm is used.

The cleaning apparatus 100 installed beneath the transfer belt 50 is mainly constituted by a cleaning blade 101, a toner storage roller 102, a toner discharge regulating member 103, a casing 104, a conveyance screw 105, a seal member 106, and a removing member 107.

The cleaning blade 101 removes toner adhering on the surface of the transfer belt 50. The cleaning blade 101 is located opposite to a stretching roller 53 and comes in contact with the surface of the transfer belt 50 in the counter direction to the rotation direction of the transfer belt 50. The material of the cleaning blade 101 is polyurethane rubber, and for example, a blade with a thickness of about 2 mm is used. Moreover, the free length of the cleaning blade 101 is about 10 mm, and the contact pressure of the cleaning blade 101 to the transfer belt 50 is 30 N/m.

In the cleaning apparatus shown in FIG. 4, in order to prevent the cleaning blade 101 from turning or twisting, toner pool T is formed by the toner storage roller 102 and the toner discharge regulating member 103.

The toner discharge regulating member 103 is made of a flexible member, and a part of the toner discharge regulating member 103 touches the surface of the toner storage roller 102. A part of toner removed by the cleaning blade 101 passes through a portion between the toner storage roller 102 and the toner discharge regulating member 103, and falls into the lower side of the casing 104. The toner accumulating the lower side of the casing 104 is collected by the conveying screw 105 at one place of the cleaning apparatus 100, and is discarded.

The seal member 106 is installed at the upstream side of the cleaning blade 101 in the rotation direction of the transfer belt 50. The seal member 106 is made of a flexible member, and the seal member 106 is curved so as to come in contact with the transfer belt 50. Therefore, the inner side of the cleaning apparatus 100 is sealed by the seal member 106 at the upstream side of the cleaning blade 101, and the transfer belt 50 does not become dirty by scattering of toner. The material of the seal member 106 is polyethylene, and has a free length of about 5 mm.

Although toner adhering on the transfer belt 50 is removed by the cleaning blade 101, foreign matter which adheres on the transfer belt 50 and has viscous properties and strong cohesive force is removed by the removing member 107. As shown in FIG. 4, the removing member 107 is installed at the upstream side of the cleaning blade 101 and at the downstream side of the seal member 106 in the rotation direction of the transfer belt 50, and comes in contact with the surface of the transfer belt 50 in the counter direction to the rotation direction of the transfer belt 50.

When an image is printed on the reverse surface of a paper sheet S at a time of double-side printing, an image formed on the obverse side of the paper sheet S comes in contact with the transfer belt 50. Accordingly, wax exuded on the obverse surface of the paper sheet S may adhere on the transfer belt 50 as foreign matter (foreign matter which has viscous properties and strong cohesive force). In order to remove such foreign matter, the removing member 107 is installed separately from the cleaning blade 101 and the seal member 106.

The material of the removing member 107 is polyethylene terephthalate, and is shaped in a flat plate. The material of the removing member 107 may be resin materials other than polyethylene terephthalate, and may be a metallic thin plate and the like.

The removing member 107 has a Young's modulus higher than that of the cleaning blade 101. Specifically, the Young's modulus of the removing member 107 is 4 GPa (desirably, 1 or more GPa) and the Young's modulus of the cleaning blade 101 is 7 MPa, Since the removing member 107 is harder than the cleaning blade 101, it becomes possible to remove foreign matter having strong cohesive force such as wax and the like from the transfer belt 50. In this regard, the seal member 106 has a Youngs modulus lower than that of the cleaning blade 101 in consideration of sealing properties, and is 1.5 MPa concretely.

Furthermore, the removing member 107 is constituted such that a contact pressure with the transfer belt 50 can be changed.

Figure 5A:
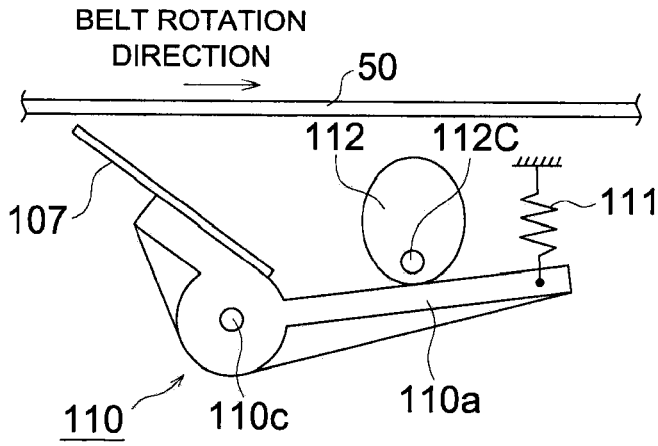
FIGS. 5*a*, 5*b* and 5*c* each is an illustration showing one example of a contact pressure changing section to change a contact pressure of a removing member to a transfer belt.
Figure 5B:
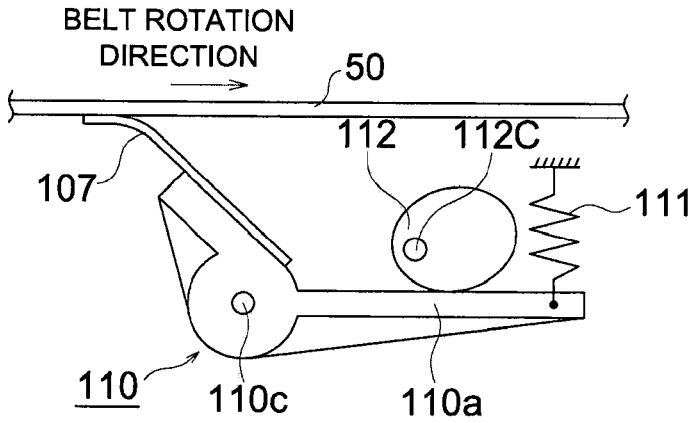
Figure 5C:
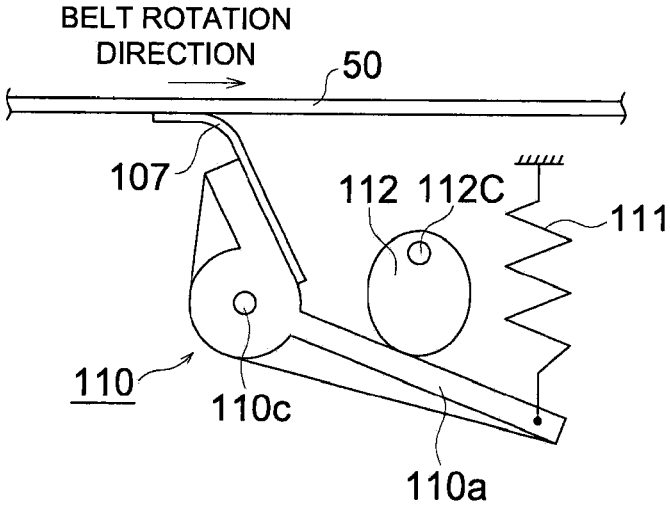

FIGS. 5*a*, 5*b*, and 5*c* each is a drawing showing an example of the mechanism of the contact pressure changing section which changes the contact pressure of the removing member 107 to the transfer belt 50. FIG. 5*a* shows the condition that the removing member 107 is separated from the transfer belt 50 so as to make the contact pressure to be zero, FIG. 5*b* shows the condition that the removing member 107 is brought in contact with the transfer belt 50 so as to set the contact pressure to be low, and FIG. 5*c* shows the condition that the contact pressure is set to be the highest.

As shown in FIG. 5*a*, the removing member 107 is fixed to a support member 110 rotatably around a shaft 110*c* as a center of rotation, and one edge of the removing member 107 is brought in contact with the transfer belt 50. A coil spring 111 is hooked on the arm section 110*a* formed integrally with the support member 110, and urges the support member 110 in the counter clockwise direction. An ellipse cam 112 which has an eccentric shaft 112*c* is brought in contact with the arm section 110*a*. Therefore, when the ellipse cam 112 is rotated by a motor (not-shown) and the like, the arm section 110*a* and the removing member 107 are rotated around the center of the shaft 110*c* so as to change the contact pressure of the removing member 107 to the transfer belt 50.

The stop position of the ellipse cam 112 is determined beforehand to stop at a plurality of positions by measurement among the states shown in FIGS. 5*a* to 5*c*.

Although the width of the removing member 107 is not clear in FIG. 4 and FIG. 5 which are side views respectively, the removing member 107 has a width corresponding to at least H, shown in FIG. 3, which is the width of an image formation area in the width direction of the transfer belt 50.

Figure 6:
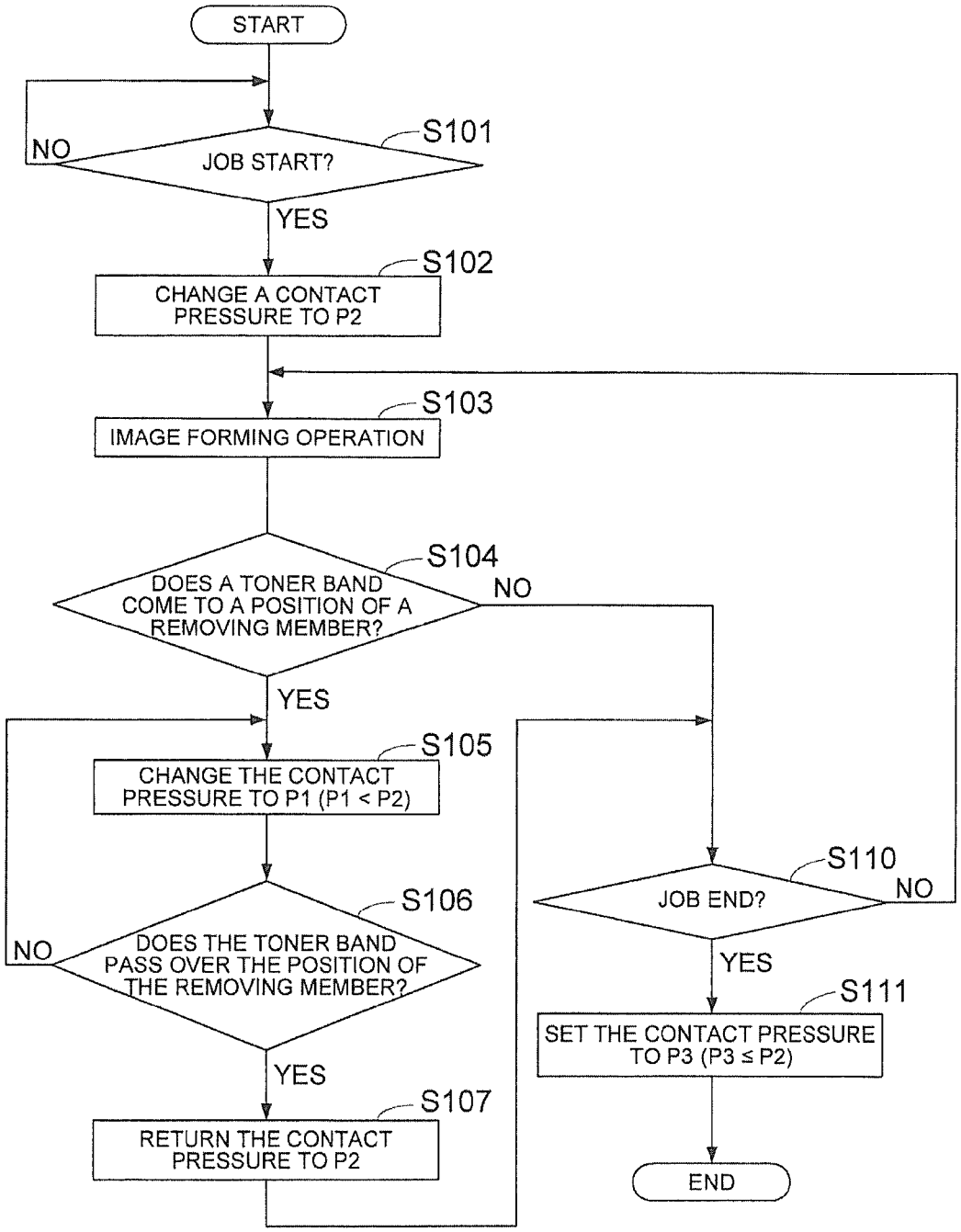
FIG. 6 is a flow chart showing a outline of operations of a cleaning apparatus provided in an image forming apparatus relating to the present embodiment.

FIG. 6 is a flow chart which shows the outline of the operation of the cleaning apparatus 100 provided in the image forming apparatus 1 relating to this embodiment. Hereafter, in the flow, the contact pressure of the removing member 107 when the toner band T transferred on the transfer belt (a belt member) 50 comes to the position of the removing member 107, is expressed as P1. Further, the contact pressure of the removing member 107 when the toner band T does not exist on the transfer belt (a belt member) 50 at the position of the removing member 107, is expressed as P2. Furthermore, the contact pressure of the removing member 107 at the time of stop of the transfer belt 50 (at a time of stop of image formation operation), is expressed as P3.

Hereafter, explanation is made in accordance with a flow. The following operations are controlled collectively by the control section C shown in FIG. 2.

First, the flow is waiting for an operation to start a job (an image formation operation) (Step S101). AT this time, the transfer belt 50 is stopped and the contact pressure of the removing member 107 is set to P3. When the contact pressure of the removing member 107 to the region of the transfer belt 50 with which toner images G are transferred to paper sheets during image formation operations, is P2, the contact pressure P3 is set so as to satisfy the conditional formula (P3≤P2).

When an operation to start a job (an image formation operation) is made (Step S101; Yes), the contact pressure of the removing member 107 is changed to P2 (Step S102). In the case where the conditional formula (P3<P2) is determined beforehand, this setting is achieved by rotating the ellipse cam 112 of the contact pressure changing section shown in FIG. 5 to a predetermined position where the contact pressure becomes P2 and sopping the ellipse cam 112 at the position. If (P3=P2) is determined beforehand, the ellipse cam 112 may be kept at the current position.

Subsequently, an image formation operation is performed (Step S103). During this image formation operation, whether a toner band T transferred onto the transfer belt 50 comes to the position of the removing member 107, is always judged (Step S104). When a region of the transfer belt 50 where a toner band T is transferred does not come to the position of the removing member 107 (Step S104; No), the contact pressure is maintained to P2, and whether the job is finished is judged (Step S110). When the job is not finished (Step S110; No), the flow returns to Step S103, and the image formation operation is repeated.

On the other hand, when a region of the transfer belt 50 where a toner band T is transferred on the transfer belt 50 comes to the position of the removing member 107 (Step S104; Yes), the contact pressure of the removing member 107 is changed to P1 (Step S105). At this time, the contact pressure P1 is made to satisfy the conditional formula (P1<P2), this setting is achieved by rotating the ellipse cam 112 shown in FIG. 5 to a predetermined position where the contact pressure becomes P1 and stopping the ellipse cam 112 at the position.

The contact pressure P1 is the condition (refer to FIG. 5(*a*)) that the removing member 107 is separated from the transfer belt 50 or the condition that the tip of the removing member 107 is separated from the transfer belt 50, and touches a toner band T on the transfer belt 50 in the thickness direction, i.e., the contact pressure P1 includes the condition of P1=0. Further, when the contact pressure P3 is also determined beforehand to be (P3<P2), similarly, the contact pressure P3 may be (P3=0).

It is desirable that the changing of the contact pressure from P2 to P1 is conducted in the region O (between a toner image G to be transferred a paper sheet and a toner band T) shown in FIG. 3. However, the changing may be conducted in the course of the situation that the tip of the removing member 107 touches a toner band T. That is, this means that all or at least a part of the formed toner band T is made to reach the cleaning blade 101 without being removed by the removing member 107.

After the contact pressure is changed to P1, the flow is made to wait until the region of the toner band T passes through the position of the removing member 107 (Step S106). When the region of a toner band T passes over the position of the removing member 107 (Step S106; Yes), the contact pressure of the removing member 107 is made to return to P2 (Step S107). It is desirable that the changing of the contact pressure from P1 to P2 is achieved in the region U (between a toner band T and a toner image G) shown in FIG. 3.

After the contact pressure of the removing member 107 is made to return to P2, the flow shifts to Step S110.

At Step S110, in the case where the job is not finished (Step S110; No), the flow returns to Step S103 and an above-mentioned operations are repeated.

In the case where the job is finished (Step S110; Yes), after the contact pressure of the removing member 107 is set to P3, the flow ends.

The above is an outline of the cleaning apparatus 100 provided in the image forming apparatus 1 relating to this embodiment.

As explained in the above, when the contact pressure of the removing member on the region of a belt member corresponding to a toner band T which is a toner image to be not transferred to a paper sheet is made P1, and the contact pressure of the removing member on the region of the belt member corresponding to a toner image to be transferred to a paper sheet is made P2, the contact pressure of the removing member is made to satisfy the conditional formula (P1<P2) by the contact pressure changing section. As a result, foreign matter such as wax and the like can be removed before reaching the cleaning blade, and an proper amount of toner can be supplied to the cleaning blade by toner bands T. Therefore, it becomes possible to provide a cleaning apparatus which can suppress poor cleaning and turning of a blade.

In the flow of FIG. 6, the contact pressure of the removing member 107 is changed to satisfy the conditional formula (P1<P2) for each time when a toner band T comes to the position of the removing member 107, but the present invention is not limited to this manner. For example, a temperature sensor and a moisture sensor are provided in the neighborhood, and it may be structured that the frequency of the changing of the contact pressure of the removing member 107 to the number of passing times of toner bands T is determined based on the combination of the detected temperature and humidity, and the frequency of the changing of the contact pressure is changed based on the combination of the detected temperature and humidity.

Figure 7:
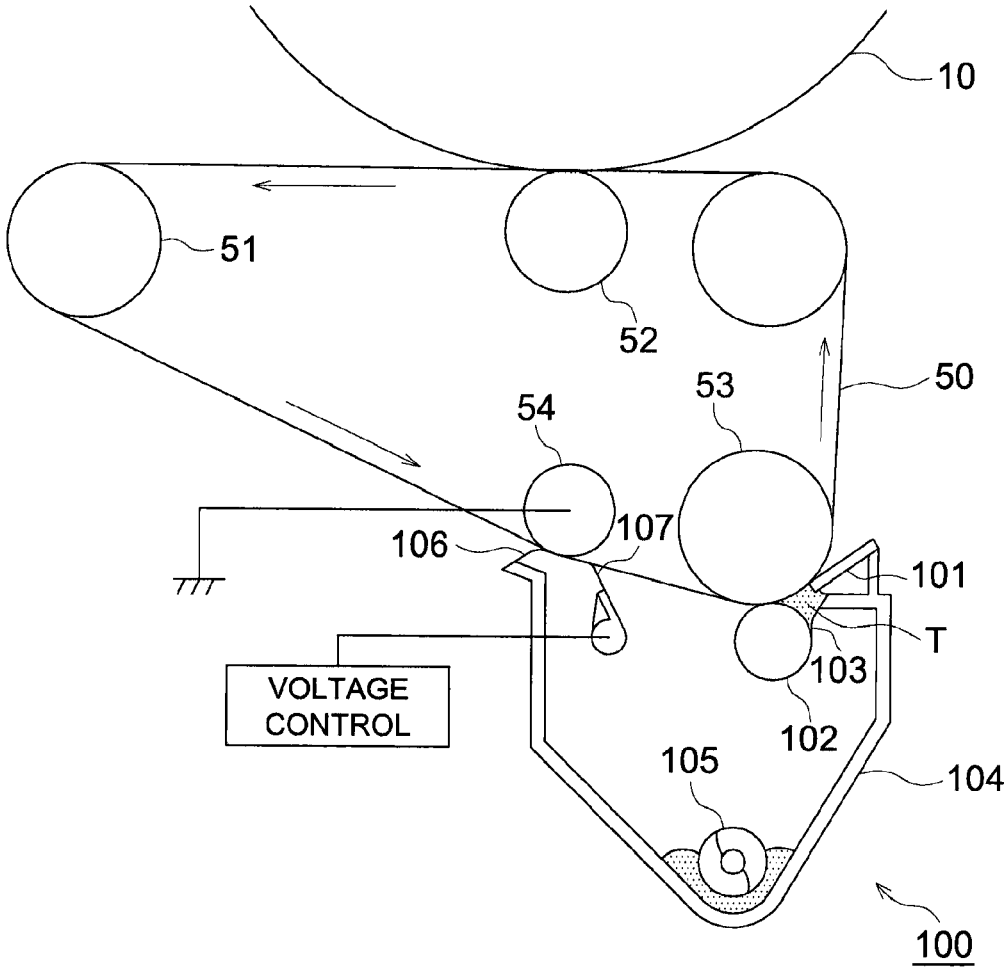
FIG. 7 is a schematic diagram showing a cleaning apparatus with a contact pressure changing section having another structure.

FIG. 7 is a schematic diagram showing the cleaning apparatus 100 with another structure of the contact pressure changing section. The cleaning apparatus 100 shown in FIG. 7 differs from what is shown in FIG. 4, only in the structure of the contact pressure changing section. Accordingly, only this different part will be explained.

The cleaning apparatus 100 shown in FIG. 7 controls electrostatic adsorptive power by providing an electric field, so that the contact pressure of the removing member 107 to a transfer belt is controlled so as to change.

Concretely, the stretching roller 54 is formed with a metal material and this stretching roller 54 is grounded to an electric ground. On the other hand, the transfer belt 50 and the removing member 107 are formed with a semi conductive material, and a bias voltage is applied to the removing member 107. Control to change the bias voltage applied to the removing member 107 can change the electrostatic adsorptive power between the removing member 107 and the stretching roller 54, thereby changing the contact pressure. In this regard, the removing member 107 may be grounded to a ground, and the bias voltage applied to the stretching roller 54 may be controlled so as to change.

With such a structure, mechanical components are made unnecessary. Accordingly, a contact pressure can be changed with a simple structure.

Figure 8:
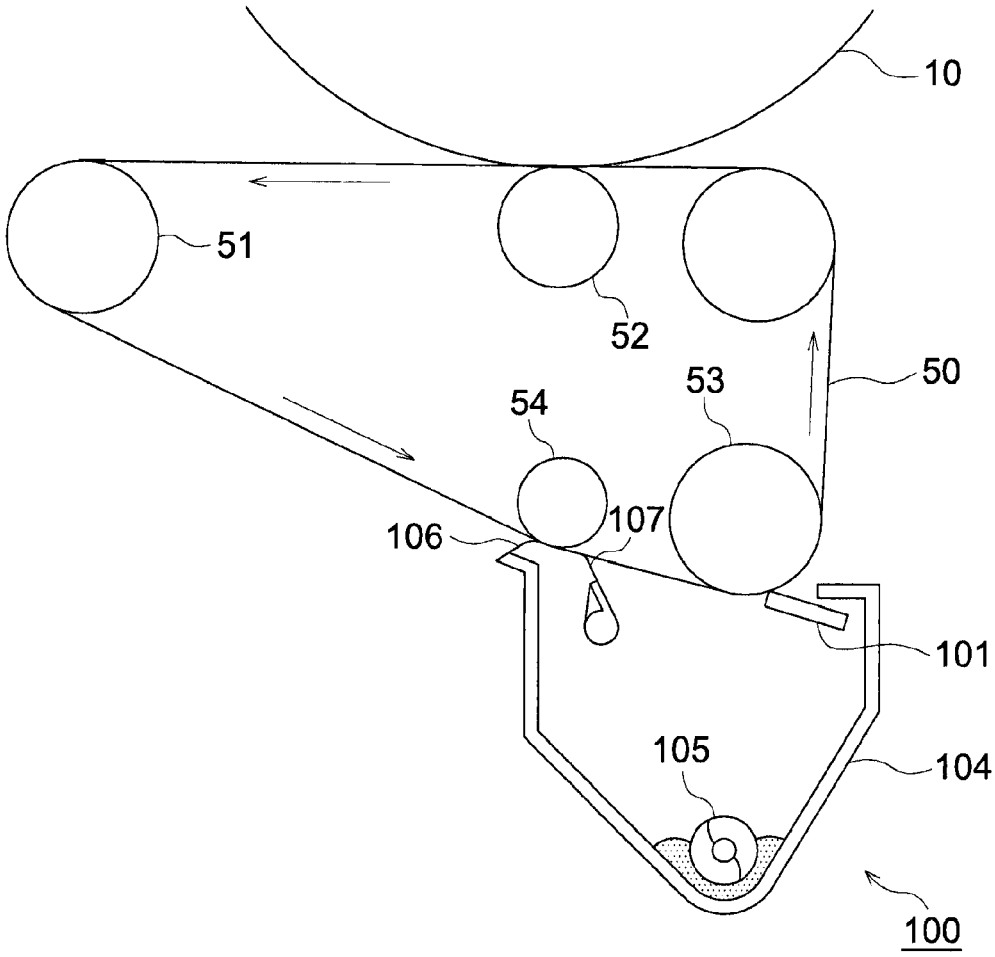
FIG. 8 is a schematic diagram showing a cleaning apparatus not having a toner storage section.

FIG. 8 is a schematic diagram showing the cleaning apparatus 100 which does not have the toner storage section.

The cleaning apparatus 100 shown in FIG. 8 is structured so as not to have a toner storage section in the vicinity of a nip portion of the cleaning blade 101.

Even with such a structure, if the removing member having the above-mentioned contact pressure changing section is arranged between the seal member 106 and the cleaning blades 101, and the same effects as the above can be acquired by controlling the above contact pressures.

As mentioned above, in the above embodiments, during image formation, when a toner band T does not come to the position of the removing member 107, the removing member 107 is adapted to come in contact with the transfer belt 50 with the contact pressure of P2. With this, toner adhering on the transfer belt 50 is removed efficiently by the removing member 107 and the cleaning blade 101.

However, it is possible that the removing member 107 is adapted to come in contact with the transfer belt 50 only at a time of double-side printing. That is, at a time of double-side printing, when an image is printed on the reverse surface of a paper sheet S, an image formed on the obverse side of the paper sheet S comes in contact with the transfer belt 50. As a result, wax exuded on the obverse surface of the paper sheet S may adhere on the transfer belt 50 as foreign matter. Therefore, when the removing member 107 is adapted to come in contact with the transfer belt 50, foreign matter can be removed by the removing member 107. However, during one-side printing, since there is little risk that foreign matter such as wax may adhere on the transfer belt 50, the removing member 107 may be separated from the transfer belt 50 so as not to come in contact with the transfer belt 50.

Also, at a time of double-side printing, when the predetermined number of paper sheets is printed, the removing member 107 may be structured so as to come in contact with the transfer belt 50.

Further, in the above-mentioned embodiments, the present invention is explained based on the example of the monochrome image forming apparatus. However, the present invention is not limited to the above, and may be applied to a color image forming apparatus which employs an intermediate transfer body (intermediate transfer belt) as the image carrying member 10, specifically, to a cleaning device of a belt member arranged opposite to a transfer position where a toner image formed on the intermediate transfer belt is transferred to a paper sheet.

The above-mentioned preferred embodiments of the present invention may be summarized as follows:

(1) A cleaning apparatus to clean a belt member which rotates by coming in contact with a part of an image carrying member on which a toner image to be transferred to a paper sheet and a toner image not to be transferred to a paper sheet are formed, comprising:

a cleaning blade to remove toner adhering on the surface of the belt member;

a removing member which is installed at an upstream side of the cleaning blade in the rotation direction of the belt member and comes in contact with the surface of the belt member in the counter direction to the rotation direction of the belt member so as remove foreign matter adhering on the surface of the belt member; and a contact pressure changing section to change a contact pressure of the removing member to the belt member, wherein, when the contact pressure of the removing member on a region of a belt member corresponding to a toner image to be not transferred to a paper sheet is made P1, and the contact pressure of the removing member on a region of the belt member corresponding to a toner image to be transferred to a paper sheet is made P2, the contact pressure changing section changes the contact pressure of the removing member to satisfy the conditional formula (P1<P2).

(2) The cleaning apparatus described in the (1) is characterized in that in the contact pressure, P1=0.

(3) The cleaning apparatus described in the (1) or (2) is characterized in that when the contact pressure is made P3 at a time of stop of the belt member, the contact pressure changing section changes the contact pressure to satisfy the conditional formula (P3≤P2).

(4) The cleaning apparatus described in any one of the (1) to (3) is characterized by further comprising a sealing member which is provided at an upstream side of the removing member in the rotation direction of the belt member and is brought in contact with the surface of the belt member so as to suppress scattering of toner removed by the cleaning blade.

(5) The cleaning apparatus described in any one of the (1) to (4) is characterized in that the removing member has a Young's modulus higher than that of the cleaning blade.

(6) The cleaning apparatus described in any one of the (1) to (5) is characterized in that the belt member and the removing member are made of a semi conductive material, a roller which is opposite to the removing member across the belt member is made of a conductive material, and the contact pressure changing section utilizes an electrostatic adsorptive power caused by an electric field between the removing member and the roller.

(7) An image forming apparatus is characterized by comprising:

the cleaning apparatus described in any one of the (1) to (6), and a fixing section for fixing a toner image transferred from the image carrying member to a paper sheet.

According to the present invention, it becomes possible to provide a cleaning apparatus and an image forming apparatus which can remove foreign matter so as not to be sandwiched by a cleaning blade, can supply toner properly to the cleaning blade, and suppress poor cleaning and turning of the cleaning blade.

What is claimed is:

1. A cleaning device for cleaning a belt member which rotates by coming in contact with a part of an image carrying member on which a toner image to be transferred to a paper sheet and a toner image not to be transferred to a paper sheet are formed, comprising:

a cleaning blade to remove toner adhering on the surface of the belt member;

a removing member which is installed at an upstream side of the cleaning blade in a rotation direction of the belt member and comes in contact with the surface of the belt member in a counter direction to the rotation direction of the belt member so as to remove foreign matter adhering on the surface of the belt member; and a contact pressure changing section to change a contact pressure between the removing member and the belt member, wherein, when the contact pressure between the removing member and a region of the belt member corresponding in position to a toner image to be not transferred to a paper sheet is made P1, and the contact pressure between the removing member and a region of the belt member corresponding in position to a toner image to be transferred to a paper sheet is made P2, the contact pressure changing section changes the contact pressure to satisfy the conditional formula: (P1<P2), and wherein the belt member and the removing member are made of a semi conductive material, the cleaning device further comprises a roller which is positioned opposite to the removing member across the belt member and is made of a conductive material, and the contact pressure changing section changes an electrostatic adsorptive power caused by an electric field between the removing member and the roller.

2. The cleaning device described in claim 1, wherein the contact pressure changing section makes the contact pressure P1 to P1=0.

3. The cleaning device described in claim 1, wherein when the contact pressure at a time of stop of the belt member is made P3, the contact pressure changing section changes the contact pressure to satisfy the conditional formula: (P3≤P2).

4. The cleaning device described in claim 1, further comprising:

a sealing member which is provided at an upstream side of the removing member in the rotation direction of the belt member and is brought in contact with the surface of the belt member so as to suppress scattering of toner removed by the cleaning blade.

5. The cleaning device described in claim 1, wherein the removing member has a Young's modulus higher than that of the cleaning blade.

6. An image forming apparatus, comprising:

an image carrying member on which a toner image to be transferred to a paper sheet and a toner image not to be transferred to a paper sheet are formed;

a belt member which rotates by coming in contact with a part of the image carrying member;

the cleaning device described in claim 1 and to clean the belt member; and a fixing section to fix a toner image transferred onto a paper sheet from the image carrying member.

* * * * *